United States Patent [19]

Braun

[11] Patent Number: 4,568,251

[45] Date of Patent: Feb. 4, 1986

[54] CYCLIC SPEED CONTROL APPARATUS IN VARIABLE STROKE MACHINES

[76] Inventor: Anton Braun, 6421 Warren Ave., Minneapolis, Minn. 55435

[21] Appl. No.: 586,798

[22] Filed: Mar. 6, 1984

Related U.S. Application Data

[63] Continuation-in-part of Ser. No. 377,086, May 11, 1982, abandoned, which is a continuation of Ser. No. 141,813, Apr. 21, 1980, abandoned, which is a continuation-in-part of Ser. No. 939,783, Sep. 5, 1978, abandoned.

[51] Int. Cl.[4] ..... F04B 11/00

[52] U.S. Cl. ..... 417/364; 123/46 SC

[58] Field of Search ..... 417/11, 340, 364, 380; 123/46 SC

[56] References Cited

U.S. PATENT DOCUMENTS

| | | | |
|---|---|---|---|
| 1,918,882 | 7/1933 | Witkiewicz et al. | 417/11 |
| 2,355,924 | 8/1944 | Pescara | 417/11 |
| 2,659,194 | 11/1953 | Huber | 123/46 SC |
| 2,701,555 | 2/1955 | Huber | 123/46 SC |
| 2,959,159 | 11/1960 | McCrory et al. | 123/46 SC |
| 3,501,088 | 3/1970 | Braun | 417/364 |
| 3,853,100 | 12/1974 | Braun | 123/46 SC |

FOREIGN PATENT DOCUMENTS

| | | | |
|---|---|---|---|
| 541779 | 12/1941 | United Kingdom | 417/340 |

*Primary Examiner*—Leonard E. Smith

*Attorney, Agent, or Firm*—Dorsey & Whitney

[57] ABSTRACT

A free piston engine includes speed control means which provide a wide range of engine speed control for selective connection and use of the engine with any one of a number of different types of energy absorbing devices. The desired control is achieved by use of two bounce chambers and a double-acting bounce piston unit specifically located at an intermediate position along the axis of reciprocation of the piston rod assembly of such an engine, i.e. between a power piston at one end of the piston rod and a connecting means at the other piston rod end for driving connection of the piston rod assembly with a movable member (e.g. reciprocating compressor piston or reciprocating electric generator member) of the selected energy absorbing device. The control means further includes at least one pair of variably adjustable bounce chamber pressure control valves (one for each bounce chamber). Each control valve of such one pair provides for and controls a direct connection of its respective bounce chamber to ambient atmospheric air outside the bounce chamber. The controls further include sensing means responsive to changes in demands on or operation of the selected energy absorbing device for variably and substantially simultaneously adjusting each control valve of such one pair and thereby similarly changing (i.e. both upwardly or both downwardly) the respective bounce chamber working pressures. Other bounce pressure control features are also described.

19 Claims, 12 Drawing Figures

CYCLIC SPEED CONTROL APPARATUS IN VARIABLE STROKE MACHINES

CROSS REFERENCE TO RELATED APPLICATIONS

This application is a continuation-in-part of my application Ser. No. 377,086, filed May 11, 1982, now abandoned, as a continuation of application Ser. No. 141,813, which was filed Apr. 21, 1980, now abandoned, as a continuation-in-part of application Ser. No. 939,783, filed Sept. 5, 1978, now abandoned.

BACKGROUND OF THE INVENTION

In devices running with their natural frequency, such as free piston machines, their frequency or cyclic speed is a function of the energy input portion and energy output portion of the device, such as the power piston energy input portion and compressor piston energy output portion of a free piston engine compressor. In other words the speed of such an engine compressor will vary in a given fixed natural relationship with variations of compressor volumetric flow and compressor intake pressures and/or discharge pressures. Thus, in a heat pump, for example, a greater volumetric flow rate is typically required at the lower intake and discharge pressures involved in operating at low ambient temperatures. However, even at maximum piston stroke, not only is the volumetric output per stroke reduced by the lower intake pressure, but the rate of volumetric flow is further substantially reduced by the lower natural frequency which the engine compressor will assume under the influence of both the lower intake and discharge pressures.

This fixed natural relationship has not heretofore been controlled efficiently over a range wide enough to prevent or overcome, in a practicable manner, the problem just described, and specifically to provide for an improved linear free piston engine capable of driving any one of a number of different types of energy absorbing devices.

In an effort to provide some extent of speed control for machines such as free piston engine compressors, one previous proposal involved a device in which the reciprocating free piston masses had hollow portions which could be filled to varying degrees with a liquid such as oil and, thus, by variation of the reciprocating masses, the speed was to be controlled within a rather limited range, since the cyclic speed varies with the mass according to the equation:

$$\int_{s_1}^{s_2} F\,ds = m\,V^2/2 \qquad \text{(I)}$$

which for a given characteristic engine, can be reduced to:

$$\int_{s_1}^{s_2} F\,ds \propto m\,n^2 \qquad \text{(II)}$$

when F is the driving force, s the stroke and $s_1$ and $s_2$ the inner and outer limits of the stroke of m (the reciprocating or driven mass), V the velocity of the mass and n the cyclic speed. As equation II shows, the mass would have to be reduced for instance to one quarter to obtain twice the cyclic speed which, in practice, would be a most difficult and most likely impractical result to achieve.

In connection with the use of free piston engine gas generators (gasifiers) for supplying exhaust gas to drive a turbine, prior efforts have been made, as in Lewis, U.S. Pat. No. 2,435,970, to control the frequency of a free piston engine by means of an additional bounce chamber in conjunction with a bounce chamber on the back side of a load compressor piston to seek lower and higher frequency limits than would be possible without such an additional bounce chamber. While Lewis suggested that his desired operation could be accomplished with the help of governors responsive to various operating conditions to adjust or respond to pressures in a number of engine locations, including direct (positive) and reverse (negative) bounce chambers and other portions of his gasifier, the Lewis patent does not disclose an engine and control combination capable of meeting the problems recognized and solved by the present inventor in the manner described in this application.

SUMMARY OF THE INVENTION

This invention involves the recognition of a need for a free piston engine which could vary engine speed over a very wide range and for selective use with any one of a number of different types of energy absorbing devices and with rather simple control elements. The desired wide control range for such an engine can be achieved by use of specially located and constructed bounce chambers, and moreover by means of lower pressures in such specially located bounce chambers capable of operating without a pressurized reservoir of high pressure bounce control fluid. In cases where the energy absorbing device involves a compressor or heat pump, such a combination is capable of operating the control section with a separate fluid from that of the working compressor or heat pump section, and with less complex control elements than would otherwise be needed. For certain uses it also recognizes a need for a vibration-free compressor with an engine speed controller and a contamination-free compressor for compressing freon or the like.

The present invention accordingly includes a speed control device that allows changing the speed of a free piston engine compressor or similar energy absorbing device (EAD) within wide margins, or maintaining the speed of a free piston engine-driven electric generator or alternator within very narrow margins, independent from conditions of the energy input section or the energy absorbing section which may, in the case of the generator require a very wide range of control to maintain a substantially constant speed, and in the case of compressor or heat pump EAD's, require substantial speed changes needed, for example, as compressor demand changes from low volume-high pressure to high volume-low pressure operation, and which in both instances is the very opposite of what the engine would do or the manner in which it would respond, if it did not include the control means and the structural arrangement and relative location of bounce chambers of this invention.

The present invention thus provides a variable stroke free piston engine which can be selectively connected to any one of several different energy absorbing devices, and in which the engine speed (frequency of reciprocation) can be controlled and adjusted in response to an extremely broad range of changes in the demands on a specific energy absorbing device (EAD) connected to and driven by the piston engine. I have found that the desired range of control forces can be effectively provided by adjustment of the working pressures in two bounce chambers specifically located at an intermediate position along the axis of a reciprocating piston rod assembly in a free piston engine which has a power piston at one end and a connecting means at the other end for driving connection with a movable member of the selected energy absorbing device. A bounce piston unit having oppositely directed and oppositely acting bounce piston faces compresses the air or gas in one bounce chamber during a power piston expansion stroke of the piston rod assembly from the power piston end toward the EAD connection end and then compresses the air or gas in the other bounce chamber during the return (i.e. compression) stroke of the power piston.

Thus the invention provides a negative first bounce chamber at a relative location between one bounce piston working face and the power piston end of the piston rod assembly, and a positive second bounce chamber at a relative location between the other bounce piston working face and the EAD end of the piston rod assembly. In the preferred embodiments, the first and second bounce chambers are most efficiently and effectively provided by a single bounce cylinder in which opposite faces of only one double-acting bounce piston are used to separate the two bounce chambers, thus eliminating half of the frictional losses that would be developed between the usual piston rings and the inner bounce cylinder wall surfaces, if the bounce piston unit had two piston members, and also minimizing the net pressure differentials between the two chambers separated by such a single bounce piston.

The invention further provides control means for such machines which includes at least one pair of bounce chamber pressure control openings (one opening in each bounce chamber), and at least one pair of variably (e.g., incrementally or intermittently) adjustable bounce pressure control valves (one for each of the bounce chamber control openings of said pair). Each control valve of said one pair, when opened partially, fully, incrementally or intermittently, provides for direct connection of the bounce chamber, through its bounce chamber pressure control opening, to the ambient atmospheric air outside the bounce cylinder. Each of said control valves is further connected to its respective bounce chamber control opening for variably and substantially simultaneously adjusting each of the variable pressure control valves of said pair and thereby similarly changing (i.e. in the same direction, both upwardly or both downwardly) the respective bounce chamber working pressures in response to changes in the demands on the particular EAD involved.

In the preferred embodiments, the control valves of said one pair are located and arranged to adjust the maximum outlet pressures for each bounce chamber. It is also possible to arrange such valves to adjust the minimum inlet pressures for each bounce chamber, or even to provide two such control valve pairs, one pair for inlet pressures and one pair for outlet pressures.

The invention also provides for the further combination of means for relatively adjusting at least one pair of the respective variable pressure control valves in opposite senses, thereby making it possible to shift the successive top dead center positions of the power piston in its power cylinder in response to a signal from an engine efficiency sensing means which indicates relative efficiency or inefficiency of combustion and operation of the engine. Such a signal can be made available, for example, from a knock sensor of the type responsive to and indicative of incipient knocking in the power cylinder, i.e. at a top dead center position of the power piston just short of that at which actual knocking might occur. Such a knock-sensing means is shown, for example, in my prior U.S. Pat. No. 3,853,100.

I have found that the use of two such bounce chambers, with a double-acting bounce piston in a single bounce cylinder which is substantially greater in cross sectional area than that of the power piston in its power cylinder, provides adequate forces on the reciprocating piston rod assembly to control very efficiently and effectively the engine speed required to meet the wide range of changes in the demands on certain EADs, such as electric linear generators, heat pumps, hydrostatic pumps, process gas compressors, and gas or oil field compressors. As a practical matter, the effectiveness of such controls is preferably enhanced by having each face of the double-acting bounce piston substantially greater in cross section area than that of the power piston by a factor in the range from at least 1.5 to at least 4 times the power piston area, and in some applications as such as 10 times the effective power piston area. With such large area ratios, I have found that most load demands on the EAD can be controlled by using ambient atmospheric air as a readily available control fluid, thus eliminating any need for a special source of highly pressurized air or gas as a control fluid for the bounce chambers. It also substantially eliminates the need for high starting pressures.

In a free piston engine, the cyclic speed of the reciprocating assembly varies closely with the square root of the total mean or average force driving the reciprocating assembly. In the present invention as just described the cyclic speed can be substantially altered by raising or lowering the pressures in each of the bounce chambers, since the component forces driving the bounce piston are a product of their respective piston areas and the corresponding pressures acting on them. By assuming commonly-employed mean effective pressures of the engine or power cylinder it can be shown that to double the cyclic engine speed the bounce pressures PB will have to be increased by approximately three times the product of the mean effective engine pressure MEP times the ratio of the power piston area AE over the bounce piston area AB, i.e. PB is nearly equal to 3 MEP (AE/AB).

This clearly shows the great advantage of the present invention of providing the freedom to select the cross sectional areas of the two bounce chambers (and of their corresponding piston) independent of the areas of the power piston, and of the compressor piston (if any). Thus doubling the engine speed of a free piston engine according to the above example will be possible with mean effective bounce pressures of only 75% that of the mean effective pressure of the power section, if the bounce piston area will be 4 times that of the power piston, which in a typical engine compressor application will be entirely practical. This contrasts sharply with previously shown designs in which the mean effective bounce pressures would have to be in excess of three times the mean effective pressure of the power section or more than 4 times as high as the pressures required according to the present invention.

Thus to control the mean bounce chamber force in a ratio of ten to one, it is simply necessary to operate the bounce chamber intake pressure between atmospheric pressure of 14.7 psia and 1.47 psia. This may be accomplished by restricting the cross-section upstream of the intake valve correspondingly. These below-atmospheric bounce inlet control pressures are practicable for large speed changes as a result of the large bounce piston area and the double-acting bounce piston unit possible according to this invention. This confirms the substantial advantage of the present invention in providing a large area for each speed control piston face, so that a very wide range of control of the engine speed can be obtained with use of ambient air at atmospheric pressure as the control fluid.

A further advantage in having the bounce chamber of the speed control section independent of the selected energy absorbing device, such as the compressor piston of a compressor or heat pump, is that the maximum pressures in the bounce chambers of the speed control section of the present invention can be kept to a minimum. Moreover, when the energy absorbing device to be removably attached to the outer end of the engine power assembly includes a compressor piston in a compressor cylinder, this compressor cylinder can also be constructed to provide a further (third) bounce chamber between the outer end of the engine and the compressor piston. Such a third bounce chamber can be used at the back side of the compressor piston in such a way as to help keep the bounce pressures in the two speed control bounce chambers of the engine substantially equal and thus to their lowest possible maximum cylinder pressure.

In some applications, such as in heat pumps and air conditioners, it is also desirable to have an initial load to avoid mechanical contact between the piston assembly and cylinder head during start up and other transient conditions. In this case one or both chambers of the speed control bouncer can be made to temporarily act as compressors until the refrigerant compressor is able to assume the power input from the driver or power section. Similar situations exist, for example, in free piston engine electric generators which could be similarly controlled by the speed control bouncer.

The invention is thus not merely in the use or control of bounce piston control pressures alone or the use of two bounce chambers as a control. It also involves the specific relative location of bounce piston faces and bounce chambers to provide adequate control piston areas without blocking or limiting the area for the EAD connection end of the engine. This further makes possible the provision and use of an optimum number of piston faces and an optimum assignment of power and control functions to such piston faces, including the allocation of speed control functions to the specifically located oppositely-acting bounce chambers and bounce piston faces and the possibility of using ambient atmospheric air as a control fluid to provide a wide range of control in a manner compatible with the selective attachment of different energy absorbing devices.

DESCRIPTION OF THE PREFERRED EMBODIMENTS

Figure 1:
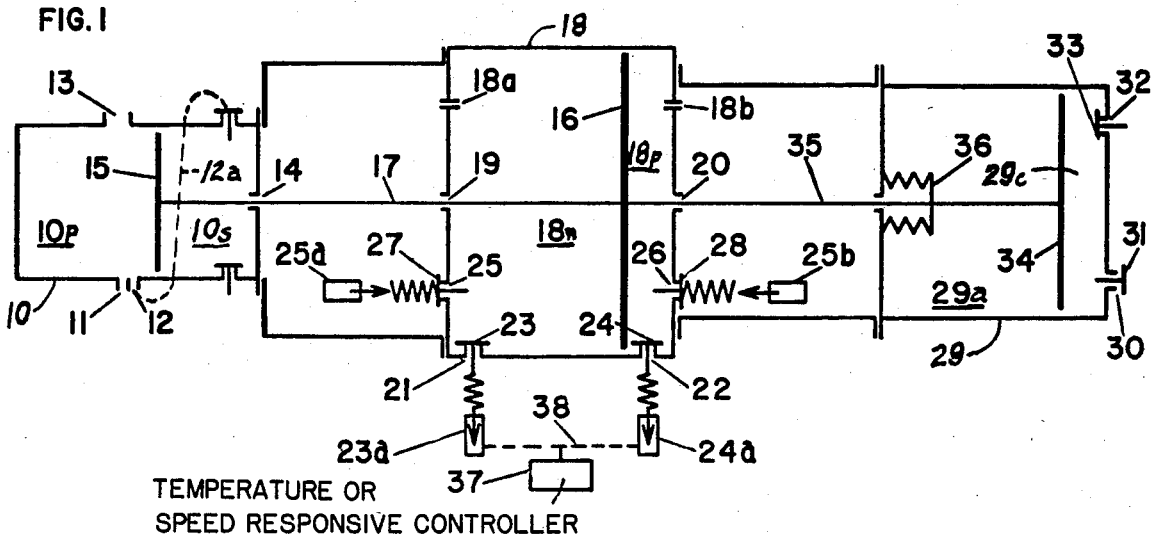
FIG. 1 of the accompanying drawing is a schematic showing of one embodiment of the invention.
Figure 2:
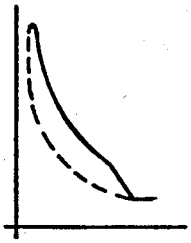
FIG. 2 is a work diagram in which the work is plotted vertically with reference to the expansion and compression strokes plotted horizontally for the power piston of an engine unit.
Figure 3:
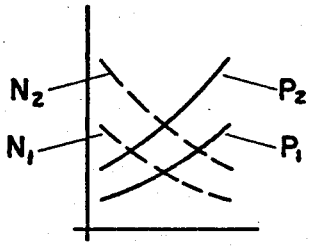
FIG. 3 is a work diagram for a bouncer unit.
Figure 4:
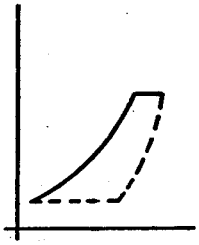
FIG. 4 is a work diagram for a compressor unit.
Figure 5:
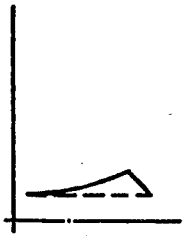
FIG. 5 is a work diagram for a scavenging unit.
Figure 6:
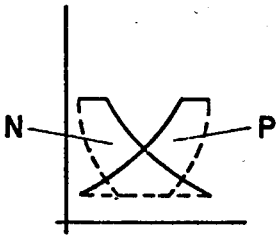
FIG. 6 is a work diagram for a bouncer unit having different inlet and outlet valve pressure settings from that of FIG. 3 allowing the bouncer at these settings to act as a compressor.
Figure 7:
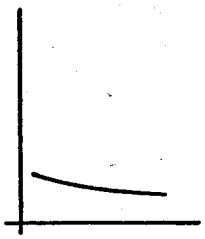
FIG. 7 is a work diagram for a negative bouncer in the compressor cylinder.

In the preferred embodiment of the invention, which is illustrated in FIG. 1, the reference numeral 10 designates a free-piston engine power cylinder which has a fuel inlet 11, an air inlet 12, an exhaust outlet 13 in a power section 10*p* of the cylinder, and conventional air inlet and outlet check valves in a scavenging air section 10*s* thereof. A power piston 15 is connected to a bounce piston 16 by a piston rod 17 extending through a bearing 14 in a wall between said pistons. Scavenging air may be suitably delivered from 10*s* to 10*p* through a conduit 12*a* by using the inner face (i.e. the right hand face, as viewed in FIG. 1) of the power piston 15 as a scavenging piston during the expansion stroke of piston 15 toward the right.

A double-acting bounce piston 16 is located in a common bounce cylinder 18 having piston rod bearings 19 and 20 and air flow inlet openings 21 and 22, one on each side of piston 16. Piston 16 divides cylinder 18 into a negative first bounce chamber 18*n* and a positive second bounce chamber 18*p*, respectively.

The respective bounce chambers are provided with pressure control means which include a pair of pressure control inlet openings 21 and 22, one in each bounce chamber, and a pair of pressure control outlet openings 25 and 26, one in each bounce chamber. An adjustable pressure-actuated inlet control or check valve 23 is located in opening 21, and a similar or identical adjustable check valve 24 is located in opening 22. Outlets 25 and 26 are provided with variably adjustable pressure-actuated high pressure outlet control valves 27 and 28 to control air flow out of the cylinder and thereby the maximum working pressures and the bounce energy in the bounce chambers.

An energy absorbing device, illustrated as a compressor cylinder 29 at the outer end of the engine, has an outlet opening 30 with a check valve 31 therein, an inlet opening 32 with a check valve 33 therein and a compressor piston 34 therein. Piston 34 is connected to bounce piston 16 by a piston rod 35, preferably through a bellows seal 36 at the other end of cylinder 29.

Inlet valves 23 and 24 have tension springs for normally closing the valve elements therein, each being manually adjustable to change the pressure drop across each valve. In the simplest case, where the clearance volume in each of the two bounce chambers is equal, the pressure drop across the valves would be simultaneously lowered or raised to control the cyclic speed of the machine. The boxes 23*a* and 24*a* have conventional manually adjustable means therein for adjustably changing the spring tension. To change the spring tension automatically, the adjustable means may be actuated by a sensor responsive to changes in demands on the selected energy absorbing device, such as the temperature of a space to be heated or the engine speed required for a specific application. For the compressor of FIG. 1, for example, a conventional speed responsive or temperature responsive sensor 37 may be connected to controls 23*a* and 24*a* through a suitable mechanism 38. In general, the sensor may be responsive to compressor flow, changes in temperature needs and/or cyclic speed requirements of the engine, or to combinations thereof, or to other suitable control signals. The sensing means itself may be of a known type but is connected through a mechanism 38 which variably and substantially simultaneously and similarly (i.e. in the same direction) adjusts each of the variable pressure control valves 23 and 24 and thereby similarly changes the respective working pressures in bounce chambers 18*n* and 18*p*. Suitable mechanisms are further described herein in connection with FIGS. 10 and 11.

For otherwise substantially constant conditions of the machine of FIG. 1, cyclic speed would be increased by reducing the pressure drop across the bounce chamber intake valves, that is, by increasing the mean effective pressure, and consequently the energy level in the bounce chambers, and vice versa, to decrease the cyclic speed. To insure proper functioning and prompt adjustment of bounce chamber pressures, the present control means includes bleed means providing a substantially continuously open limited leakage path of small effective cross section primarily out of each bounce chamber. Such leakage paths are provided, for example, by the small bleed openings 18*a* and 18*b* in FIG. 1.

All of valves 23, 24, 27 and 28 are located and constructed for direct connection between the corresponding bounce chambers and ambient atmospheric air outside the bounce cylinder. Non-pressure-actuated valves (not shown) may also be provided in series with or in lieu of the valves 23 and 24.

Figure 11:
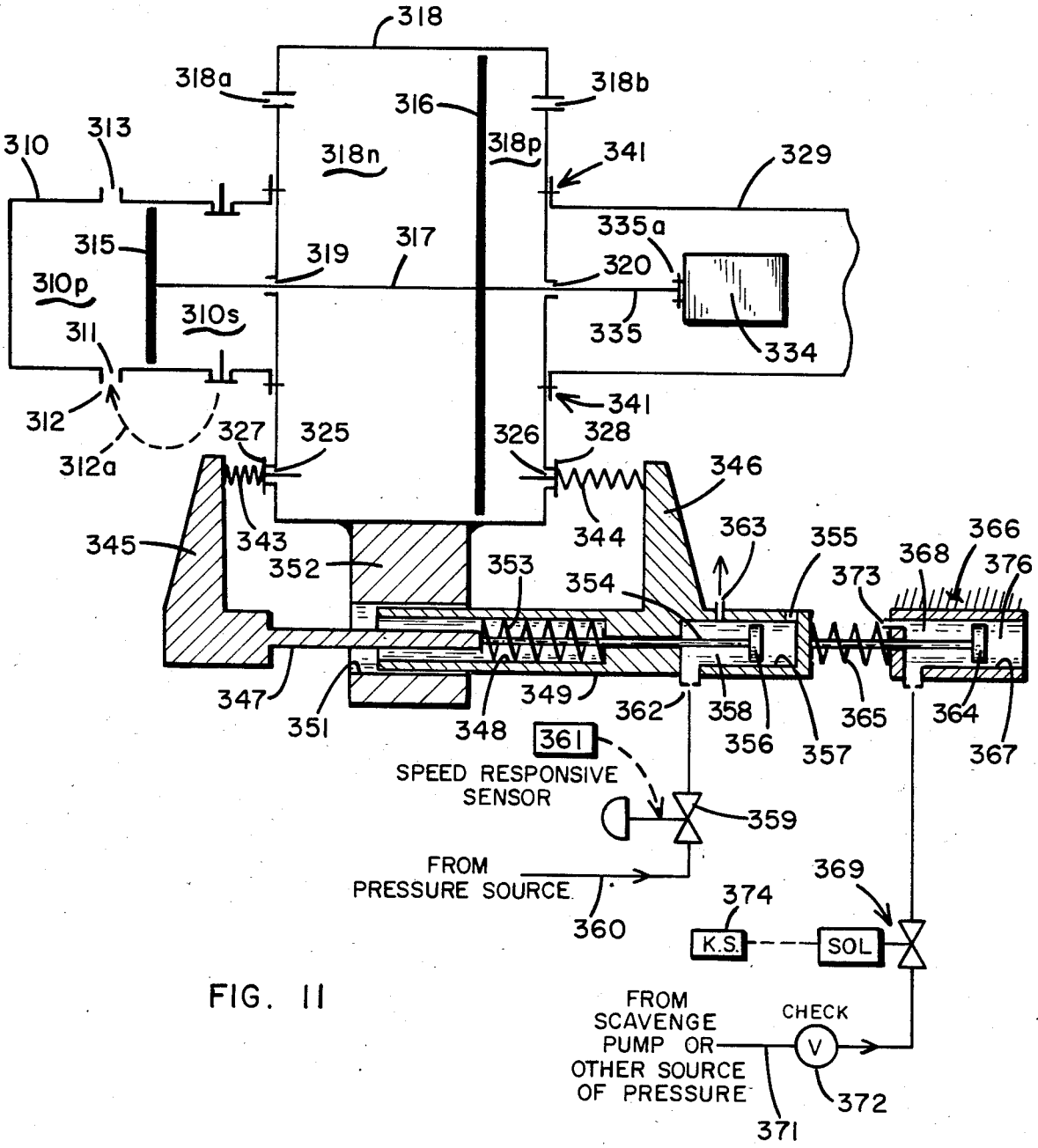
FIG. 11 is a schematic showing, similar to FIG. 10, of another modification of the invention.

The outlet valves 27 and 28 have compression springs therein for normally holding the valves closed. They likewise have conventional means 25*a* and 25*b* for adjusting their compression. Automatic means can be provided as shown in FIG. 11 to adjust these valves in a manner similar to that for valves 23 and 24. Such adjustment may be in addition to or in place of the means for valves 23 and 24. In many machines it is most effective to provide such automatic variable adjustment and control for the outlet valves 27 and 28 only, and insure proper functioning by providing any required flow into the bounce chambers through preset inlet check valves 23 and 24, in which case the small bleed openings 18*a* and 18*b* can be eliminated.

In the operation of the machine, combustion of fuel in the chamber to the left of piston 15 causes the power assembly (power piston 15, bounce piston 16 and piston rod 17, 35) and attached compressor piston 34 to move to the right. This causes a build-up of pressures in the scavenge air chamber 10*s* to the right of piston 15, in the positive bounce chamber 18*p* at the right face of piston 16 and in the compression chamber 29*c* to the right of piston 34. A reduced pressure occurs in the negative bounce chamber 18*n* at the left face of the bounce piston 16. The chamber 29*a* to the left of compressor piston 34 may be exposed to ambient atmosphere, but should preferably be constructed to provide a third bounce chamber between the compressor chamber and bounce chamber 18*p* for establishing the basic work balance between the work in the power section and the work in the compressor section. The energy stored in the bounce chambers is regained by their use to return the power assembly and compressor piston to their left hand positions for the next power stroke.

In drawing FIGS. 2 through 7, the work diagrams have the power stroke lines shown as solid lines while the return lines are shown as broken lines. It can thus be seen that the net work per cycles of each unit of the machine is the difference in the areas under each of the lines. In order to prevent one or more of the pistons from striking the end of the enclosing cylinder, the valves in the bouncer unit may be adjusted temporarily to cause the bouncer to act as a compressor and, thereby, temporarily increase the load to absorb the energy of the engine.

Figure 8:
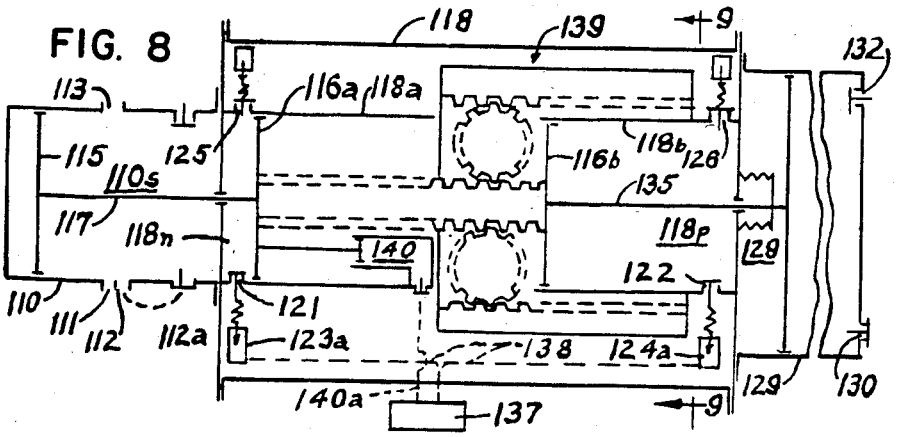
FIG. 8 is a schematic showing of a modification of the invention.
Figure 10:
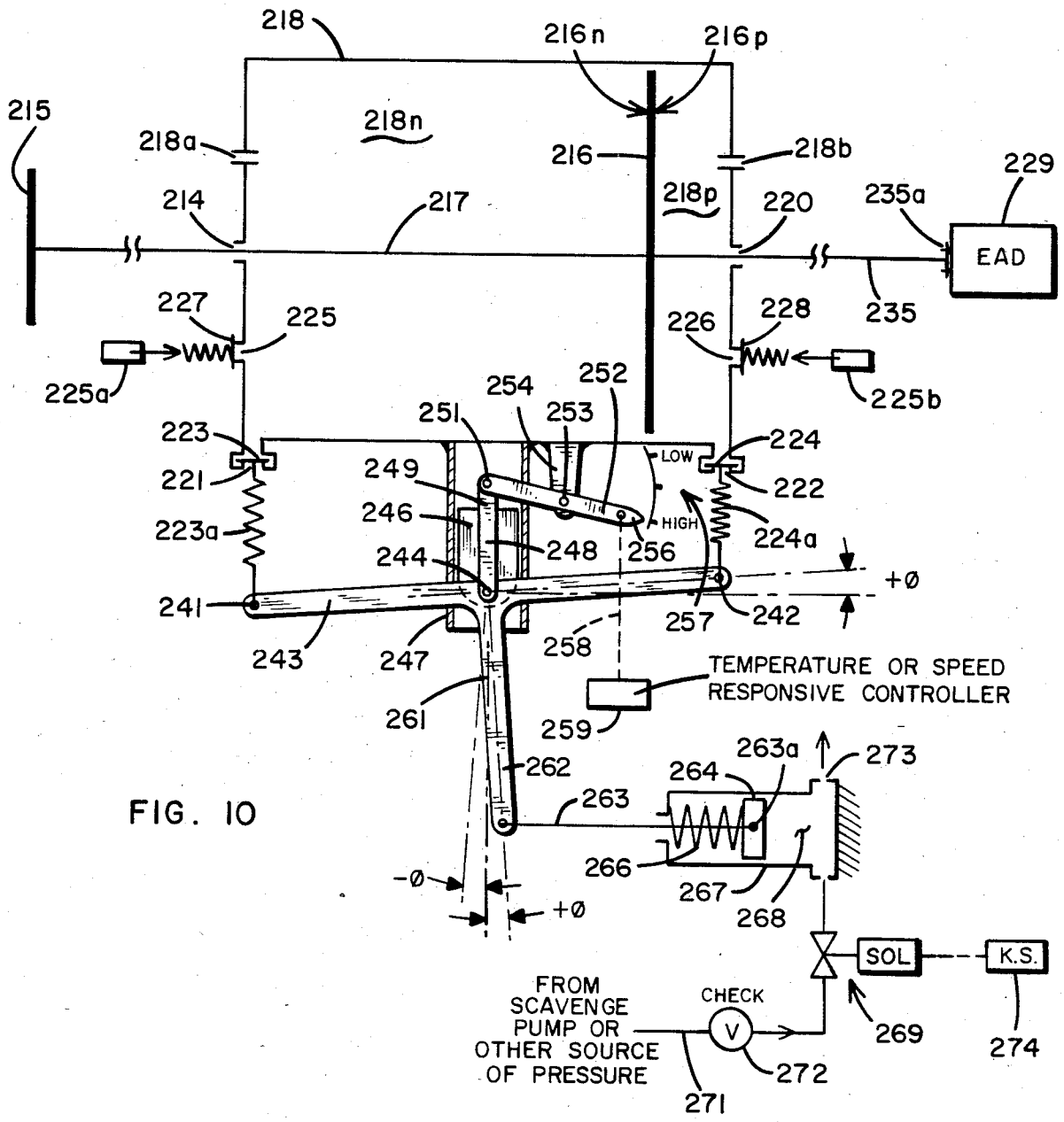
FIG. 10 is a schematic showing, similar to FIG. 1, of another preferred embodiment of the invention.

In the event that the invention is operating in a heat pump that presents a mismatch problem between demand and capacity, particularly for heating in cold weather conditions, all that has to be done to compensate for a normal drop in capacity at low ambient temperatures, is to adjust the inlet valves 23 and 24 in FIG. 1, or 123*a* and 124*a* in FIG. 8, or the respective valves in FIGS. 10 and 11, to increase the pressure in the bounce chambers and thus increase the speed of the machine. This may be done automatically by sensor 37 or 137 sensing outside air temperature and adjusting the valves in accordance with it or, if no sensor is provided, by adjusting the valves manually.

The piston rod and power assembly in the engine of FIG. 1 thus provides two pistons with a total of four working faces, one for the power section, one for the scavenging section, and two for the bounce chambers of the control section. When this assembly is connected to the working piston of a compressor type of energy absorbing device, the two additional piston faces provided by such working piston can also be fully utilized, i.e. one face as a compressor working face, and the other face as a bounce control piston face for a further (i.e. third) bounce chamber control section. Thus a maximum range of speed control is obtainable within the general constraints imposed by the maximum allowable cylinder pressures and space limitations.

The modification of the invention illustrated in FIG. 8 is basically the same in relative location and control of bounce chambers as that of FIG. 1 in that it has a power cylinder 110 at one end, a connection to a compressor 129 at the other end, and a bouncer assembly 118 with separate negative and positive bounce cylinders 118*a* and 118*b* providing negative and positive bounce chambers 118*n* and 118*p*, respectively, between the power piston end of the power assembly and the opposite end of the piston rod, which is attached to drive the compressor piston. However, a Braun counterbalancing mechanism 139, such as disclosed in U.S. Pat. No. 3,501,088 and a small compressor 140 have been added to provide a vibration free compressor and a higher pressure air source for varying the air pressure in the bounce chambers. A sensor and control means 137 controls the air pressures in the bounce chambers in response to engine speed. Air flows from auxiliary compressor 140, through conduit 140*a* to sensor controlled means 137 and through conduits 138 to valve adjusters 123*a* and 124*a*.

The negative bounce chamber is designated by numeral 118*n* and the positive by 118*p*. Other elements similar to those of FIG. 1, have numbers differing by 100. Thus fuel inlet 111, air inlet 112 receiving scavenging air through conduit 112*a* from chamber 110*s*, exhaust opening 113, openings 121, 125, 122, 126, 130 and 132 correspond to openings 11, 12, 13, 21, 25, 22, 26, 30 and 32 in FIG. 1. Other elements in FIG. 8 similarly correspond to those in FIG. 1.

Figure 9:
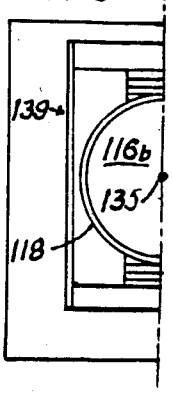
FIG. 9 is a fragmentary sectional view of the modification of FIG. 8, taken along line 9—9 of FIG. 8.

The operation of the FIGS. 8 and 9 modification is the same as that of FIG. 1 except that the smaller diameter bouncer pistons require higher air pressures to properly adjust the bounce pressures. The smaller bounce pistons are necessary to enable the counterbalancing outer racks to straddle the bouncer cylinders as they move in the opposite direction to the movement of the pistons.

FIG. 10 is a schematic diagram similar to FIG. 1, showing another preferred embodiment of the present invention, in which the variable stroke free piston machine includes a power assembly with a piston 215 at one end of the axially movable piston rod 217, 235 and with a connection means 235*a* at the second or outer end of the piston rod for selective and removable driving connection to an appropriate energy absorbing device 229 which could be the piston of a compressor, as in FIG. 1, or an axially reciprocable electric generator member, or the piston of a heat pump assembly. Between power piston 215 and the connection 235*a*, the power assembly includes a double-acting bounce piston 216, which moves back and forth axially within a bounce cylinder 218, so that the respective faces 216*n* and 216*p* of piston 216 divide the bounce cylinder 218 into an inner or negative first bounce chamber 218*n* between the power piston and the bouncer piston, and an outer or positive second bounce chamber 218*p* on the opposite side of the bouncer piston 216, i.e. between the bouncer piston and the outer piston rod end carrying the load connection 235*a* for the working member of the energy absorbing device or load. To achieve the desired range and flexibility of control within practical lisits for such a total power assembly, the effective cross sectional area of the double-acting bouncer piston 216, is substantially greater than that of the power piston, as already described, by a factor in the range from at least 1.5 to at least 4 times the area of the power piston 215.

Elements in FIG. 10 which correspond to similar elements in FIG. 1 are given numbers in the 200 series, with the last two numbers corresponding generally to the similarly numbered parts in FIG. 1. Thus the controls for the bounce chambers 218*n* and 218*p* include respective inlet openings 221 and 222 controlled by spring loaded inlet valves 223 and 224. These valves are biased downwardly in FIG. 10 by adjustable springs 223*a* and 224*a* which are connected respectively to the outer ends 241 and 242 of a generally horizontal control lever 243 pivoted on a horizontal (as shown) axis or shaft 244 carried by a vertically movable support slider 246. This slider is supported in turn for limited vertical movement within a tubular vertical housing 247 having its upper end secured to the bottom of the bounce cylinder 218 or a corresponding frame portion.

The vertical position of the movable support slider 246 may be adjusted by a vertically movable link 248 having its lower end pivoted on shaft 244 and its upper end 249 pivoted at 251 to one end of a two-armed lever 252 pivoted at an intermediate point 253 to another supporting bracket or frame member 254. The outer end 256 of lever arm 252 can be positioned along a scale 257 to establish a relatively lower or higher pressure range simultaneously within each of the bounce chambers 218*n* and 218*p*, by pushing the pivot point 244 of the control lever 243 downwardly to a greater or lesser degree and thus increasing or reducing to a corresponding extent the tension of springs 223*a* and 224*a* which control the entrance of atmospheric air to both bounce chambers at the low end of the pressure range which is achieved in such chambers as the volume of each bounce chamber approaches its maximum.

The relative position of lever arm 252 may be controlled manually or automatically. In FIG. 10, an automatic control is shown, in which the outer end 256 of lever arm 252 is connected as shown schematically at 258 to a speed responsive or temperature responsive controller shown schematically at 259.

As in the device of FIG. 1, the respective bounce chambers 218*n* and 218*p* are provided with constantly-open bleed openings or orifices 218*a* and 218*b*, respectively. These orifices provide limited but desirable and substantially continuous leakage of air from the bounce chambers to help reach the desired bounce pressures for which the inlet valves 223 and 224 are being controlled.

In this case, as in FIG. 1, the bounce chambers are provided with pressure relief openings 225 and 226, which are capable of substantial relief of pressure from stroke to stroke, at whatever maximum pressure range has been established by the variable pressure relief valves 227 and 228. The relief pressure for these valves can again be set by manual adjustment of the spring tension therein or—as further described in FIG. 11—they may be controlled substantially simultaneously (due to the rapid back and forth strokes of the bouncer piston 216 with the piston rod assembly 217, 235) to control the apparatus by correspondingly limiting the maximum pressures within the two bounce chambers.

A further feature of the control mechanism shown in FIG. 10 involves the possibility of relative adjustment of the inlet pressures in either bounce chamber to slightly different levels than exist at their respective operational settings. For this purpose, the lever arm 243 includes an integral downwardly projecting adjusting arm 261 perpendicular to arm 243 which can be controlled at its lower end 262 to rock the complete lever member 243, 261 in a clockwise or counterclockwise direction around its supporting pivot 244, in response to control signals from another sensor, such as the well-known knock sensors for signaling incipient knocking of an engine within its power cylinder.

As shown in FIG. 10, the lower end 262 of lever arm 261 may be normally urged to the right by a connecting link 263 pivotally connected at 263*a* to a horizontally movable piston 264, urged to the right in FIG. 10 by spring 266 within cylinder 267. The rocking of the lever arm 261 to the right in FIG. 10 will reduce the tension of spring 224*a* and correspondingly increase the tension of spring 223*a*, so that air can enter bounce chamber 218*p* at a slightly higher pressure in chamber 218*p* and could enter bounce chamber 218*n* at a slightly lower pressure in chamber 218*n* than existed just before such movement of lever end 262 to the right. If a lower entrance pressure setting is desired for the bounce chamber 218*p* and a higher entrance pressure for the bounce chamber 218*n*, then the lower end of lever arm 261 can be pushed to the left in FIG. 10 by admission of air under appropriate pressure to the control chamber 268 at the right of piston 264.

Such pressure can be applied under the control of a normally closed solenoid valve 269 which can be opened to admit compressed air or gas, either from the scavenge pump of such an engine or from any other source of pressure indicated generally at 271, which supplies the necessary pressurized control air or gas through check valve 272. The chamber 268 in which piston 264 can be moved against the urging of spring 266 by an increase of pressure within the chamber is also provided with a bleed opening 273, in order to permit reduction of pressure in chamber 268 and corresponding movement of piston 264 back to the right under the influence of spring 266, to the extent that the normally closed solenoid valve 269 is not being actuated in response to a signal indicating incipient knock at the power cylinder. Such a knock sensing device is indicated schematically at 274 in FIG. 10.

Thus, if the total engine conditions involving power piston, bounce piston and load member or energy absorbing device are such that the piston rod of the power assembly is being driven back on its compression stroke to such a degree as to lead to incipient or actual knocking, the signal from a well-known type of knock sensor will open the normally closed solenoid valve to increase the pressure in chamber 268, move piston 264 and lever arm 262 gradually to the left, and thus rock the lever arm 243 so as to increase the tension of spring 224*a*, decrease the tension of spring 223*a*, and thus substantially simultaneously (because of the frequency of the engine strokes) make it more difficult for air to enter the bounce chamber 218*p*, less difficult for air to enter bounce chamber 218*n*, and thus rapidly establish a lower range of pressure in the positive bounce chamber, with a corresponding reduction in the force exerted against face 216*p* of the double-acting bounce piston during the return or compression stroke of the piston assembly, and a corresponding and substantially simultaneous increase in the pressure range within chamber 218*n*, which—in turn—will reduce the work available in chamber 218*p* in contributing to the inward compression stroke of the piston rod and similarly increase the resistance of the pressure in chamber 218*n* to the inward compression stroke of the piston rod and thus eliminate or prevent knocking in the power cylinder.

When the knock sensor signal is thus eliminated, valve 269 will resume its normally closed position, and the escape of pressure from chamber 268 through bleed opening 273 will reverse the control process, all of which happens within short time intervals, in view of the relatively high frequency of reciprocation of the piston rod in this type of free piston engine. The "top-dead center" position of the power piston will intermittently (within these short time intervals) oscillate between the incipient knock position and a small distance short of this point of maximum engine efficiency, irrespective of where the position of incipient knocking may occur under the influence of operating conditions such as engine intake air temperature, air-to-fuel ratio, throttle position, octane number of fuel, altitude and others. Thus the engine is enabled to operate under any nominal setting at the point of the highest efficiency that its general condition is capable of.

The device of FIG. 10 further emphasizes the advantages of providing a single bounce cylinder with closed ends through which a piston rod assembly, with a power piston at one end and an energy absorbing load device connection at the other end can reciprocate axially, and in which the rod is provided with a double-acting bounce piston inside the bounce cylinder, which defines two bounce chambers of substantially equal circular cross section. Thus equal and opposite absolute volume changes are available in the two bounce chambers as the piston rod moves axially back and forth. The provision of two such oppositely acting bounce chambers in this particular location and relative arrangement between the power piston and load connection ends of the power assembly facilitates the rapid and accurate control of the pressure ranges in such bounce chambers for optimum engine performance.

Moreover, the preferred provision of bounce piston faces (cross-sectional areas) which are not only substantially equal to each other in the respective bounce chambers, but are also substantially larger, as shown in FIGS. 1 and 10, than the area of the power piston, makes it possible to provide total bounce chamber forces (i.e. piston area times instantaneous pressure) great enough to establish and/or maintain the desired high degree of control over the operation of the piston rod and power assembly under the varying load and frequency conditions required by whatever specific energy absorbing device (e.g., compressor piston, heat pump assembly piston, or axially movable electric generator member) is selected for connection to the outer end of the piston rod.

Small changes in the bounce inlet valve pressures at the low ends of each bounce chamber pressure range, as established by the settings of the bounce chamber variable pressure inlet valves, can result in much higher ratios of pressure differences at the high ends of such bounce chamber pressure ranges, while the maximum pressures at such high ranges can also be controlled by the settings of the respective bounce chamber variable pressure relief valves.

The small constantly-open bleed openings, such as 218*a* and 218*b*, further provide limited inlet and outlet functions in each bounce chamber, and their function should be included in certain cases. Such function can also be achieved as part of the construction or operation of the variable pressure bounce chamber valves, or by limited leakage along the shaft seals at the respective end walls of the bounce chambers, or even by limited leakage around the periphery of the bounce piston from one bounce chamber to the other. In all cases, however, the desired functions of such bleed openings should be supplemented (or provided) by at least one pair (one in each bounce chamber) of variable bounce chamber pressure inlet control valves, or one pair (one in each bounce chamber) of variable bounce chamber pressure relief valves, or preferably by both such pairs.

FIG. 11 shows an embodiment of the invention in which the desired control of the free piston machine is specifically achieved by a pair of pressure relief outlets 325 and 326 (one in each of the bounce chambers 318*n* and 318*p*). These pressure relief outlet means are controlled by variable pressure outlet valves 327 and 328 as shown schematically in FIG. 11. A pair of small constantly-open bleed openings 318*a* and 318*b* (one in each of the bounce chambers 318*n* and 318*p*), is also provided. Both the bleed openings and the variable pressure relief valves are shown, for example, as located in the axial end walls of bounce chamber 318, which are also provided with central bearing portions and seals at 319 and 320 to receive the axially movable piston rod assembly 317, 335. This rod has a power piston 315 at its inner end and a connection 335*a* at its outer end for readily removable connection to a moving member 334 of a selected energy absorbing device 329 which is also removably secured to the outer end of the machine at 341.

Elements in FIG. 11 which correspond to similar elements in other figures are given numbers in the 300 series, with the last two numbers corresponding generally to the similarly-numbered parts in FIG. 1. Thus the power piston 315 moves axially within a power cylinder 310 and compresses the appropriate fuel mixture in combustion chamber 310*p* during a compression stroke of the power assembly 317, 335 and its associated parts from right to left in FIG. 11. Combustion of the fuel mixture in chamber 310*p* then drives the power piston 315 and associated piston rod to the right in FIG. 11 in the appropriate power stroke needed for operation of the energy absorbing device member 334. The double-acting bounce piston 316 carried by the piston rod divides the cylindrical bounce chamber 318 into a first bounce chamber 318*n* toward the power piston end of the machine and a second bounce chamber 318*p* toward the load connection means at the other end of the machine. These bounce chambers are used for control of the machine, and the controls include the constantly open restricted openings 318*a* and 318*b*, respectively (one in each chamber) in combination with the pair of pressure relief openings 325 and 326 controlled by variable pressure valve members 327 and 328, respectively described above. The closing forces of the valves are adjustably set by spring members 343 and 344 which are compressed between the valves and two respective control abutments 345 and 346. Abutment 345 projects upwardly from a slider member 347 which is supported for relative sliding within the hollow receiving chamber 348 of a telescoping outer slider member 349. Slider 349, in turn, is relatively slidable along the same axis as member 347 within the channel 351 of a slide support 352 secured to the bottom of bounce cylinder 318 or to an appropriate frame member of the engine.

A spring 353 positioned within the chamber or recess 348 in outer slider 349, i.e. between the inner end of recess 348 and the supported end of slider member 347, normally urges the two slider members 347 and 349 in oppositely outward directions, tending to reduce the spring pressures applied at 343 and 344 to the relief valve members 327 and 328.

To provide for relative movement of sliders 347 and 349 toward each other to reduce the distance between abutments 345 and 346 and thus increase the spring pressures on outlet valves 327 and 328, the inner slider member 347 is provided with an extension shaft 354 extending axially through the outer slider 349 to a piston 356 within a control cylinder 357 at the outer end of slider member 349 which carries abutment 346. To move the respective sliders 347 and 349 and their abutments 345 and 346 toward each other, pressure may be increased within the cylinder chamber 358 at the left side (as viewed in FIG. 11) of piston 356.

For this purpose, a variable pressure regulator valve 359 connected to a source 360 of pressurized air or gas can feed such pressurized fluid through inlet 362 into chamber 358 in response to signals from a suitable sensor shown schematically at 361, such as a signal from a speed responsive sensor indicating an undesired decrease in speed or frequency of the free piston machine. A vent 355 keeps the outer end of cylinder 357 at ambient pressure, so piston 356 is free to move out in response to pressure increases in chamber 358.

The increased valve closing pressures of springs 343 and 344 can thus provide increased maximum pressure levels within the respective bounce chambers 318*n* and 318*p* to increase the speed of engine operation until the signal from the speed regulator permits regulator valve 359 to close. At that point, pressure will be relieved within chamber 358 of the slider cylinder 357 by means of the small bleed orifice 363. If the pressure drops to a point where the sliders move apart far enough to cause another undesired drop in engine speed, the control process just described will be repeated, so that the engine speed may vary slightly in a cyclical manner close to the desired engine speed. This control arrangement responds to undesired decreases in speed, but it should be understood that such a control system could also be made responsive to undesired increases in engine speed.

As further shown in FIG. 11, the slider members 347 and 349 and their spring-controlling abutments 345 and 346 can be moved axially as a unit to increase the relief pressure imposed by spring 343 and simultaneously decrease the spring pressure imposed by spring 344, or vice versa. For this purpose, a piston 364, rigidly connected to the outer end of slider 349 is received in a control cylinder 367 fixed to a stationery engine part or frame at 366. A spring 365 between the outer end of slider 349 and the inner end (left end, as viewed in FIG. 11) of fixed cylinder 367 normally urges the total assembly of sliders 347 and 349 in a direction (left in FIG. 11) to apply maximum spring pressure at 343 on relief valve 327 and to apply minimum spring pressure at 344 on relief valve 328.

To position the sliders against the force of spring 365, the pressure in cylinder chamber 368 may be controlled, for example, in response to signals from a known knock sensor 374 of the type described in connection with FIG. 10. Thus the signal from such an incipient knock sensor can open a solenoid-controlled valve 369 to feed compressed air or gas from an appropriate source 371 (such as the scavenge pump chamber 310*s* or any other suitable source of pressure) through a check valve 372 into the inlet of chamber 368. Such pressure on the inner face of piston 364 will exceed the ambient pressure through the open end of cylinder 367 against the outer face of piston 364 and will thus urge the sliders 347 and 349 jointly toward fixed cylinder 367, and hold the sliders in an operating position where the respective bounce chamber maximum pressures are expected to provide satisfactory engine performance. The pressure available from source 371, and the effective area of piston 364, must be great enough to overcome the force from spring 365, and move the sliders far enough to the right (in FIG. 11) to reduce the maximum outlet pressure at bounce pressure control valve 328, and result in engine performance which no longer provides a knock sensor signal. Valve 369 will then close, and bleed orifice 373 will provide for slow release of pressure from chamber 368 to let the sliders move back and increase the bounce relief pressure at valve 326, so that the engine operation can again approach the incipient knocking point, where operation is generally believed to be most efficient. Thus the upper dead center position of power piston 315 can cycle within a narrow range close to the incipient knock point to maintain the desired efficiency of engine operation.

The control systems shown in FIG. 11 operate to provide the desired bounce chamber pressure ranges by variably controlling the maximum pressures within such chambers, without relying on the controls at the low pressure ends of such ranges as more fully described in connection with FIG. 10.

Figure 11A:
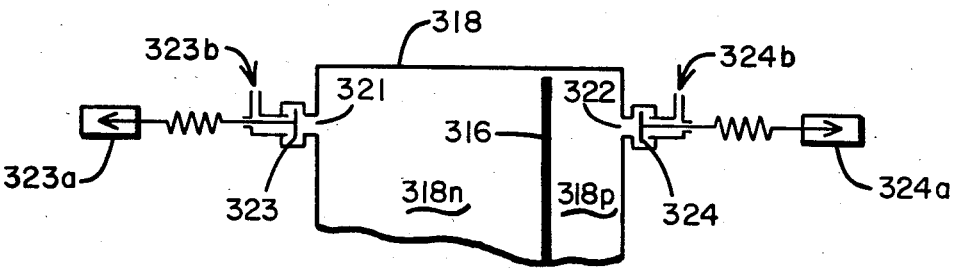
FIG. 11A is a partial schematic view of a preferred modification of the device of FIG. 11.

FIG. 11A shows a preferred modification of the device of FIG. 11, in which the pair of small constantly open bleed openings 318*a* and 318*b* are replaced by inlet openings 321 and 322 controlled by one-way inlet valves 323 and 324 for the respective bounce chambers 318*n* and 318*p*. The inlet pressures at which the inlet valve will open may be preset, or variably adjusted as shown schematically at 323*a* and 324*a* and the inlet valves are provided with restricted orifices 323*b* and 324*b* which are "upstream" from the bounce chamber inlet openings and one-way valve portions. Such restricted orifices are open directly to the ambient air at atmospheric pressure and are restricted primarily to limit the rate at which air can be sucked into the respective bounce chambers during the intervals in which the one-way check valves are open. Such restricted orifices may be as small as 0.02 inches in effective diameter, to limit the inward flow of ambient air when the inlet valves are opened. The inlet valves are thus useful in providing for limited replacement of control air within the respective bounce chambers, while the major control of bounce chamber working pressures is achieved as described in connection with FIG. 11 by the indicated variable adjustments of the maximum pressures at which the respective bounce chamber exhaust valves 327 and 328 will be opened. The inlet check valves can be set, however, to let the control means work with higher bounce pressures.

The modifications of FIGS. 11 and 11A have both safety and operating advantages in providing a particularly wide range of bounce chamber control pressures primarily by controlling the maximum pressures in such chambers.

Thus the present invention provides a wide range of control possibilities by providing at least one "negative" or inner bounce chamber positioned toward the power piston end of such an engine, i.e. between a bounce piston face on the piston rod of the engine and the power piston itself, in combination with a so-called "positive" or outer bounce chamber positioned toward the outer end of the engine, i.e. between the inner bounce chamber and the load connection means at the other end of the piston rod of the free piston engine assembly.

The available flexibility of control provided by such relative locations and by the indicated relative cross sectional areas of the bounce chambers helps to make possible the use of different energy absorbing devices with the same basic power unit, by selectively and removably connecting such different devices, as shown schematically at 335*a* and 341 in FIG. 11, to the closed outer end of the outer bounce chamber or to some other appropriate frame part, and by using the same power assembly and piston rod 317, 335 to drive the desired movable member 334 of the particular energy absorbing device chosen for a specific application.

When the energy absorbing device is a working compressor (or pump), as specifically shown in FIG. 1, the invention provides a relative location of engine parts which permits the compressor or pump chamber to be separated from, and thereby effectively sealed off from the engine speed controlling bounce cylinders. This permits use of a working fluid in the compressor or pump chamber which is different from e.g. incompatible with the controlling fluid, such as air, which is used in the engine bounce cylinders.

While the invention is specifically illustrated in a free piston engine for driving a compressor, it may also be used in such an engine for driving an electric alternator or some other energy absorbing device (EAD) that is subject to varying loads as described herein, or which requires an engine responsive to a wide range of changes demanded by a particular load device. Modifications may be made in the embodiments described herein within the intent and scope of the following claims.

I claim:

1. A variable stroke free piston engine comprising a power assembly having an axially reciprocable piston rod with opposite first and second ends, a power piston secured to the first end, a connection means at the second end for driving a movable member of a selected energy absorbing device (EAD), and a double-acting bounce piston unit secured to the piston rod between said first and second ends and having first and second bounce piston working faces respectively facing toward the first and second piston rod ends for simultaneous axial reciprocation of the rod, power piston, bounce piston unit and EAD connection means as a unit during successive alternating power piston compression strokes toward the first end and power piston expansion strokes toward the second end of the piston rod, axially-fixed bounce cylinder means cooperating with the bounce piston unit and providing a negative first bounce chamber at a relative axial location between the first bounce piston working face and the power piston end of the piston rod and a positive second bounce chamber at a relative axial location between the second bounce piston working face and the EAD connection end of the piston rod, and control means for said engine comprising at least one pair of bounce chamber pressure control openings (one in each bounce chamber), at least one pair of variably adjustable bounce pressure control valves (one for each of the bounce chamber control openings of said pair), means connecting each control valve of said one pair to its respective bounce chamber control opening for variably adjusting the working pressures in its respective bounce chamber, and means responsive to changes in demands on the selected energy absorbing device and operatively connected to said one pair of control valves for variably and substantially simultaneously and similarly (i.e. in the same pressure-changing direction) adjusting each of the variable pressure control valves of said one pair during operation of the engine and thereby similarly changing the respective bounce chamber working pressure in each bounce chamber both upwardly or both downwardly for effectively controlling the engine frequency to meet such changes in demand.

2. A free piston engine according to claim 1 in which the area of each first and second bounce piston working face is greater than the working area of the power piston by a factor in the range from at least 1.5 to at least 4 times the area of the power piston.

3. A free piston engine according to claim 2 in which the areas of each of the first and second bounce piston working faces are substantially equal to each other.

4. A free piston engine according to claim 1 in which the bounce chamber pressure control openings of said at least one pair of openings, and the corresponding variably adjustable bounce pressure control valves of such pair, are located and constructed for direct connection between the corresponding bounce chambers and ambient atmospheric air outside the bounce cylinder means, when said control valves are open, said bounce chambers effectively controlling the engine without requiring a pressurized reservior of high pressure bounce control fluid.

5. A free piston engine according to claim 4 in which the bounce cylinder means comprises a single common bounce cylinder providing the first and second bounce chambers, and in which the first and second bounce piston working faces are opposite faces of a single bounce piston which reciprocates within the common bounce cylinder and separates the respective first and second bounce chambers within such bounce cylinder.

6. A free piston engine according to claim 5 in which the selected energy absorbing device is a piston machine having a compressor cylinder coaxial with the engine piston rod and in which its movable member for connection to the second end of the power shaft is a compressor piston supported for axial movement within such compressor cylinder.

7. A free piston engine according to claim 6 in which the compressor cylinder and the compressor piston provide a compressor chamber separated from, and thereby effectively sealed off from, said engine bounce cylinder for use of a working fluid in the compressor chamber which is different from e.g. incompatible with whatever control fluid, for instance air, is used in the engine bounce cylinder.

8. A free piston engine according to claim 6 in which a scavenging section is provided in the engine between the rear (inner) face of the power piston and the negative first bounce chamber and in which the compressor piston of the selected energy absorbing device has one face serving as a working compressor face and an opposite face serving as a bounce piston face in a further bounce chamber located between the working compressor chamber and the positive first bounce chamber of the engine.

9. A free piston engine according to claim 1 in which said control means includes further engine control means having an engine efficiency sensing means responsive to an engine operating condition, said efficiency sensing means being operatively connected to the variably adjustable bounce chamber pressure control valves of at least said one pair for variably and substantially simultaneously and oppositely (i.e. in opposite directions) adjusting each of the variable pressure control valves of said pair and thereby shifting the relative bounce chamber working pressures in opposite directions relative to each other and thereby shifting successive top dead center positions of the power piston and piston rod in a relative axial direction tending to maintain the desired engine efficiency.

10. A free piston engine according to claim 9 in which said engine efficiency sensing means includes an anti-knock sensing device responsive to incipient engine knocking at power piston top dead center positions just short of those at which actual knocking could take place.

11. A free piston engine according to claim 1 in which said control means also includes a second pair of bounce chamber pressure control openings (one for each bounce chamber) and a corresponding second pair of bounce pressure control valves (one for each bounce chamber), and in which the respective control valves of the second pair are adjustable for further controlling the bounce chamber pressures.

12. A free piston engine according to claim 11 in which said control means also includes bleed means providing a limited leakage path of small effective cross section out of and into each bounce chamber.

13. A free piston engine according to claim 1 in which each bounce chamber has bleed means comprising a small bleed opening providing a substantially continuously open limited leakage path between each bounce chamber and the ambient atmosphere outside such bounce chamber, and in which the variable bounce pressure control valves further control the relative flow of air between the respective bounce chambers and the ambient atmosphere outside such bounce chambers.

14. A free piston engine according to claim 1, in which the selected energy absorbing device is a compressor, and said double-acting bounce piston unit and bounce cylinder means have a counterbalancing unit at least partially surrounding them, said engine also having a reversing mechanism connected between said counterbalancing unit and said piston rod.

15. A free piston engine and compressor combination according to claim 14, wherein said reversing mechanism includes racks and pinions.

16. A free piston engine according to claim 1 in which the bounce pressure control valves of said one pair are bounce inlet pressure control valves for selectively adjusting the minimum inlet pressures of each bounce chamber.

17. A free piston engine according to claim 1 in which the bounce pressure control valves of said one pair are pressure relief outlet valves for selectively adjusting the maximum internal pressures of each bounce chamber.

18. A free piston engine according to claim 17 in which the control means includes a second pair of bounce chamber pressure control openings (one in each bounce chamber) and a pair of bounce inlet pressure control valves (one for each control opening of said second pair) for establishing the minimum inlet pressures of each bounce chamber.

19. A free piston engine according to claim 18 in which the bounce inlet pressure control valves include a restricted orifice open to ambient atmospheric air and thereby limiting the inward flow of such air into said bounce chambers when said inlet pressure control valves are opened in response to relatively lower pressures within such bounce chambers.

* * * * *